US008167622B2

(12) United States Patent
Zhou

(10) Patent No.: US 8,167,622 B2
(45) Date of Patent: May 1, 2012

(54) POWER PLUG WITH A FREELY ROTATABLE DELIVERY POINT

(75) Inventor: Jian-Lin Zhou, Dong-guan (CN)

(73) Assignee: Mig Technology Inc., Dongguan (CN)

( * ) Notice: Subject to any disclaimer, the term of this patent is extended or adjusted under 35 U.S.C. 154(b) by 53 days.

(21) Appl. No.: 12/629,732

(22) Filed: Dec. 2, 2009

(65) Prior Publication Data

US 2011/0130044 A1 Jun. 2, 2011

(51) Int. Cl.
*H01R 39/00* (2006.01)

(52) U.S. Cl. ..... 439/21

(58) Field of Classification Search ..... 439/21, 439/20, 22

See application file for complete search history.

(56) References Cited

U.S. PATENT DOCUMENTS 5,954,519 A * 9/1999 Hsiao ..... 439/21
5,997,310 A * 12/1999 Chiu et al. ..... 439/21
6,302,743 B1 * 10/2001 Chiu et al. ..... 439/652
6,719,578 B1 * 4/2004 Klassen et al. ..... 439/289
7,914,292 B2 * 3/2011 Honda ..... 439/21

* cited by examiner

*Primary Examiner* — Neil Abrams

(57) ABSTRACT

A power plug with a freely rotatable delivery point is disclosed, wherein a relative orientation between a delivery point element (e.g. an electric wire) and insertion terminals of the plug can change freely on a plane. A plug seat includes an armature which displaces axially. An open end of the seat is loosely connected with a turntable which is coaxial with the armature. The turntable is assembled with the insertion terminals which loosely contact with the armature by relative rotation. Between the seat and the armature, an elastic arch element is axially provided and parts of the insertion terminals relative to the armature are indirectly provided with plate-shaped conducting probes with an elastic shear. By the elastic arch element and the conducting probes, a mechanical vibration wave occurring during rotation of the turntable is absorbed, such that the armature can actually contact with the terminals to avoid jump sparks.

7 Claims, 2 Drawing Sheets

POWER PLUG WITH A FREELY ROTATABLE DELIVERY POINT

BACKGROUND OF THE INVENTION a) Field of the Invention

The present invention relates to a power plug with a freely rotatable delivery point and more particularly to a power plug, wherein a relative angle between insertion terminals and a seat can rotate freely to avoid jump sparks and facilitate operation when rotating the insertion terminals. The power plug includes primarily a plug seat, an interior of which is assembled with an armature and a turntable that is coaxial with the armature. The turntable provides for installation of the insertion terminals, an opposite longitudinal surface between the armature and the seat is indirectly provided with an elastic arch element and plate-typed conducting probes with an elastic shear are indirectly provided between the insertion terminals and the armature. By an elastic stress action between the elastic arch element and the conducting probes, a mechanical vibration wave of motion can be absorbed to avoid gap jump.

b) Description of the Prior Art

A fixed-type power socket is normally located on a vertical wall or a floor of a building to be securely fixed, such that safety can be gained in using an electric appliance and electricity can be extracted for use conveniently. An orientation between an ordinary plug and an electric wire carried by the plug is fixed and an orientation at which the fixed-type socket is fixed into insertion holes on the wall is not changed. Therefore, under a condition that an orientation at which the plug is assembled with the carried wire is fixed, if the plug is inserted at an orientation not conforming to an orientation of electric wiring, an assembly section of the electric wire with the plug will be distorted. In particular, for an electric appliance with a larger demand of electric current, an electric wire carried by the power plug is coarser, which results in a larger mechanical stress, such that it will be difficult to carry out insertion and wiring or even that a plate-typed insertion terminal needs to be bended. The aforementioned shortcomings also apply to an electric appliance, such as a vacuum cleaner or an electric tool, as a location of which needs to be changed constantly, thus a working direction is also changed constantly. As a result, the assembly orientation of the plug and the electric wire carried by the plug should be able to be changed freely, such that the assembly end of the electric wire with the plug can be prevented from distortion.

Regarding to an ordinary design for adjusting the orientation between the insertion terminals of the plug and the carried electric wire, the orientation between the plug seat and the insertion terminals can be changed by indirectly providing the armature between the insertion terminals and the seat, such that the orientation of electric wiring can be altered. There is another rotatable plug, wherein a casing is directly formed with a groove and after a ring-shaped conducting plate is assembled, a surface layer of the conducting plate can provide for connection with the insertion terminals. In addition, the seat is directly provided with an inter-layered armature which conducts electricity to each terminal by layers to explicitly divide positions of energizing, thereby avoiding mechanical deformation of the terminals to result in short-circuiting. Furthermore, there is a layered conducting structure which is assembled coaxially, with each layer providing electricity to each respective terminal, so as to achieve an application of the layered armature.

However, for conducting electricity, whether contact between conducting elements is tight and solid or not will directly affect an efficiency of transmitting the electric current. If the contact is inherently imperfect or a jump occurs when a gap is caused by a vibration wave which is produced when the orientation is changing, then resistors will generate heat or jump sparks will be formed, causing an unnecessary loss. The best solution is to directly connect between the electric wires, without having indirect structures. Yet, considering that the orientation between the plug and the electric wiring should be freely adjustable, it will require elements of relative motion to conduct the electric current indirectly. Therefore, the contact between the indirect elements has to be assured, so that the electric current can pass through a better path, stable energizing can be provided when the plug is moving and jump sparks can be prevented.

SUMMARY OF THE INVENTION

The primary object of the present invention is to provide a power plug with a freely rotatable delivery point, wherein a plug seat of the present invention includes a planar armature which can displace forward and backward along an axial direction, the armature corresponds coaxially to a turntable to provide assembling with terminals, an end of each terminal is provided with a conducting slip ring which contacts with and conducts the armature respectively and an elastic arch element is provided between an interior of the seat and the armature to effectively absorb a mechanical vibration wave when the terminals rotate relatively to the armature, assuring that the terminals can actually contact with the armature, thereby forming a smooth path through which the electric current can flow easily and providing a smooth mechanical operation.

Another object of the present invention is to provide a power plug with a freely rotatable delivery point, wherein an end of insertion terminal toward a contact point with the armature is extended with a conducting probe with an elastic shear, which can absorb a mechanical gap jump produced when the terminal moves relatively to the armature, allowing the elements to be clearly in touch with one another and facilitating the electric current to flow through a smooth path.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

A power plug with a freely rotatable delivery point includes insertion terminals of the plug, wherein a relative orientation between an electric conducting element (electric wire) carried by the plug and the plug can change freely. Basically, the plug which is referred to in the present invention is an F-typed plug, wherein the provided insertion terminals are located at an end surface relative to a plug seat to rotate by any angle on a plane, removing a vibration wave between the elements during movement, such that electricity can be actually conducted, sparks can be avoided and a mechanical operation can be successful.

The present invention comprises primarily a seat, an interior of which is formed with an indented space to install a planar armature that can displace axially. A center of the armature aligns exactly with a center axis of the seat and is coaxially overlapped. A working plane of the armature is distributed with plural conjugated conducting slip rings of unequal radii and corresponds coaxially outward with a turntable which can rotate freely. The turntable provides for implantation of the insertion terminals, a bottom end of each insertion terminal conducts respectively the conducting slip ring of the armature and the conducting slip rings are connected outward with an electricity conducting element (e.g., electric wire).

The armature is a single free body which is assembled in the seat 1 and is then radially positioned by internal structures of the seat 1, but can displace axially up and down. On a longitudinal relative surface of the seat 1 and the armature, an elastic arch element is provided to arch the seat 1 and the armature. By an elastic arching force of the elastic arch element, the armature can be pressed toward roots of the terminals provided by the turntable, enabling solid contact and absorbing a mechanical vibration wave which occurs when the turntable is rotating, such that the root of each terminal can be assured to actually contact with the conducting slip ring of the armature at any time, thereby maintaining a smooth flow for an electric current, avoiding temperature increase of resistors and a danger of jump sparks.

On the other hand, in a path of the root of the insertion terminal toward the conducting slip ring of the armature, there is extended with a conducting probe with an elastic shear action. By an elastic force which is stored when the probe is extended, it is able to facilitate self absorption of a mechanical vibration wave which occurs between the elements when the turntable is rotating, thereby assuring the smooth flow of the electric current.

Figure 1:
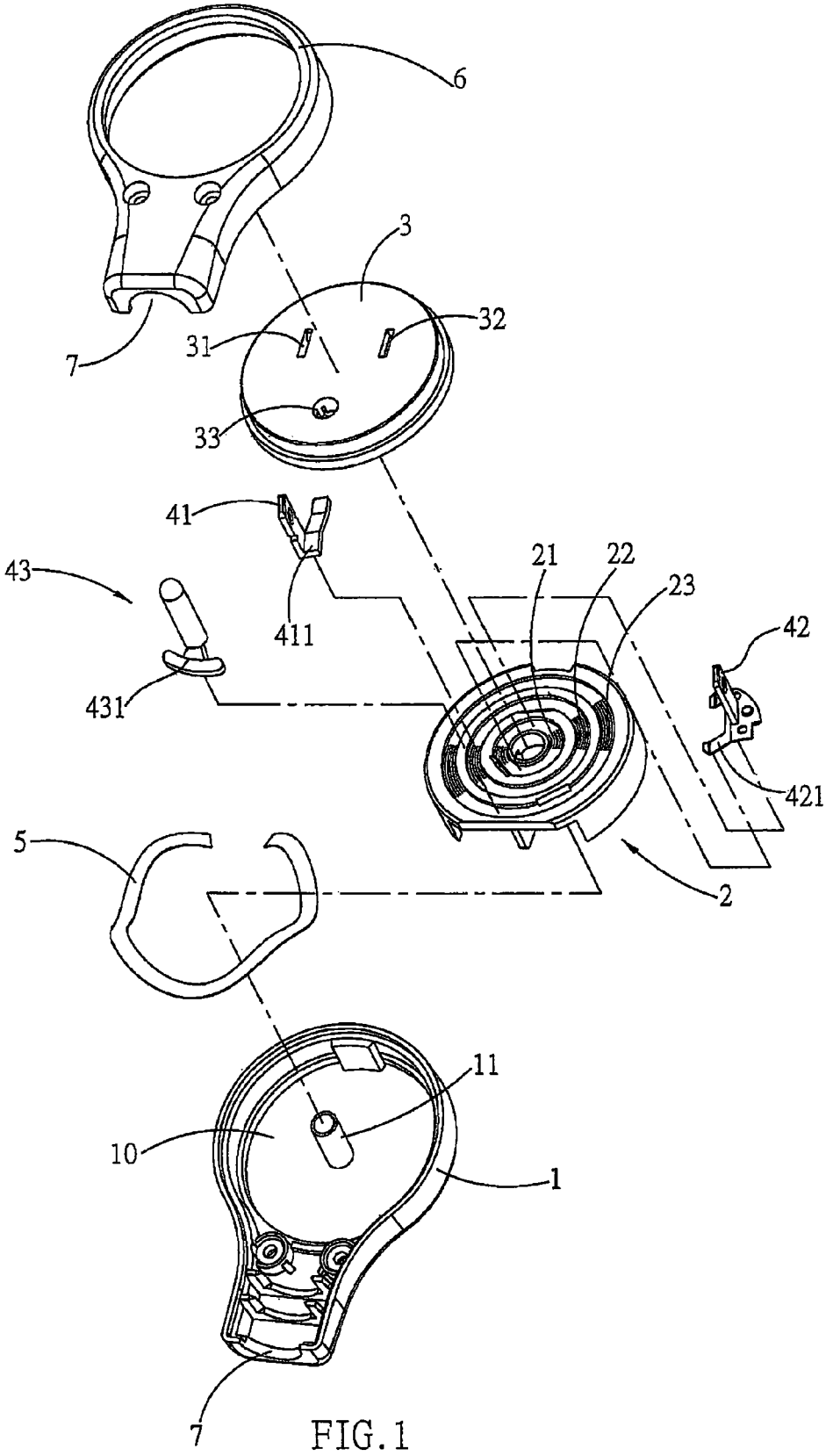
FIG. 1 shows an exploded view of each part of the present invention.
Figure 2:
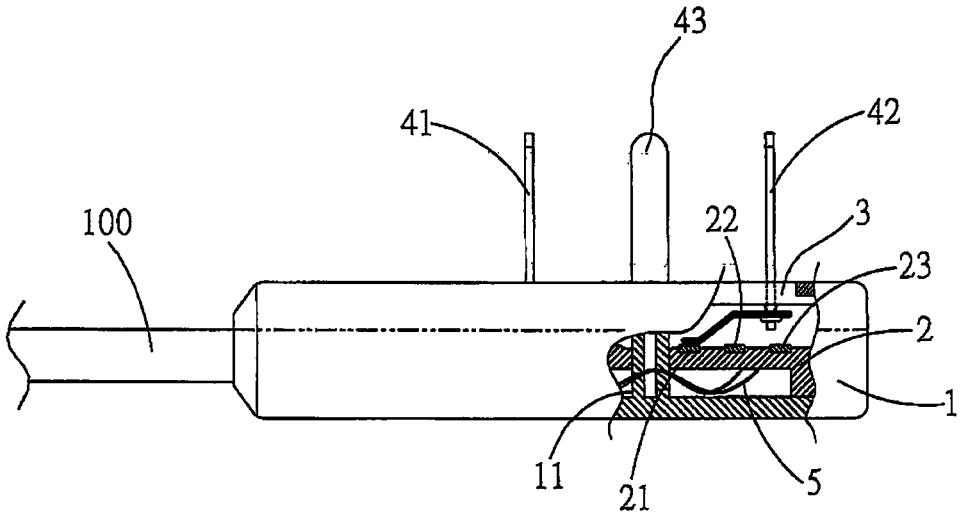
FIG. 2 shows a side view of FIG. 1 after being assembled.

Referring to FIG. 1 and FIG. 2 for detailed structures and working principles of the present invention, the present invention comprises primarily the seat 1, the interior of which is provided with an indented circular space and a center part of which is protruded with a center axis 11 to form an open end 10 on a surface; and a planar single-body armature 2, a surface of which is radially distributed from a center point with a first conducting slip ring 21, a second conducting slip ring 22 and a third conducting slip ring 23 of unequal radii. The armature 2 is coaxially assembled with the center axis 11 in the interior of the seat 1 and is radially positioned by internal structures of the seat 1, yet can displace axially. In addition, a displacement distance of the armature 2 is limited that the armature 2 will not escape and will displace axially forward and backward along a longitudinal direction of the center axis 11. The provided first conducting slip ring 21, second conducting slip ring 22 and third conducting slip ring 23 are connected respectively outward with an electricity conducting element 100 (as shown in FIG. 2).

A working plane of the armature 2 is conjugated with a turntable 3 which can rotate on a plane. A radial surface of the turntable 3 is distributed with a first implantation hole 31, a second implantation hole 32 and a third implantation hole 33 which provide respectively for implantation of a first insertion terminal 41, a second insertion terminal 42 and a third insertion terminal 43 and are positioned and assembled at the turntable 3. Body parts of the first insertion terminal 41, second insertion terminal 42 and third insertion terminal 43 are fixed by the turntable 3 and deep root parts are extended respectively to contact with the first conducting slip ring 21, second conducting slip ring 22 and third conducting slip ring 23 that belong to the armature 2.

As the turntable 3 and the armature 2 are coaxially overlapped, the turntable 3 can rotate on the surface of the armature 2 to drive the first insertion terminal 41, second insertion terminal 42 and third insertion terminal 43 rotating synchronously and the armature 2 is radially positioned by the seat 1, thus a rotation angle of the turntable 3 will determine an angular shift relative to the armature 2, forming an absolute relative motion, with the angle of relative motion being an angle by which the plug rotates. Therefore, the electricity conducting element 100 will be also dragged to rotate by an orientation.

The first conducting slip ring 21, second conducting slip ring 22 and third conducting slip ring 23 of the armature 2 can explicitly contact electrically with the roots of first insertion terminal 41, second insertion terminal 42 and third insertion terminal 43 of the turntable 3, avoiding jump sparks produced by a mechanical vibration wave. On the other hand, a relative surface between the seat 1 and the armature 2 is assembled with an elastic arch element 5 which constitutes an elastic arching force to form an elastic restraining force in a fixed orientation to press the first conducting slip ring 21, second conducting slip ring 22 and third conducting slip ring 23 toward the turntable 3, such that by the elastic restraining force, the first conducting slip ring 21, second conducting slip ring 22 and third conducting slip ring 23 of the armature 2 can maintain the explicit contact with each root of the terminal of the turntable 3. The mechanical vibration wave which is produced when the turntable 3 is rotating can be absorbed by the elasticity of the elastic arch element 5 to remove gap jump, thereby keeping the first conducting slip ring 21, second conducting slip ring 22 and third conducting slip ring 23 of the armature 2 at actually conducting electricity with the roots of first insertion terminal 41, second insertion terminal 42 and third insertion terminal 43, and avoiding a danger of jump caused by the mechanical vibration.

The elastic arch element 5 can restrain at an equal orientation on the plane of the armature 2. As a result, it is preferable that the elastic arch element 5 is in a shape of ring and can be a metallic ring in a wavy cross section, an elastic rubber in a same wavy shape or an elastic rubber ring.

The aforementioned turntable 3 is loosely fixed at the seat 1 along the same axis and is engaged with a tail end of the center axis 11 that the turntable 3 will not escape outward. The present invention is further provided with a hoop 6 which can be assembled relatively with the seat 1. An inner circle of the hoop 6 can form a boundary for a movement of outer circle of the turntable 3 and constitute a longitudinal limit to the turntable 3, allowing the turntable 3 to freely rotate on the plane without escaping longitudinally.

The hoop 6 can be assembled with the seat 1 by any means, such as by fixing with screws or latching, wherein each end of the seat 1 and the hoop 6 is provided with a bonding slot 7. When the two bonding slots 7 are assembled, the electricity conducting element 100 can be bonded. If the electricity conducting element 100 is an electric wire, then an electric wire bonding action is formed to achieve an associated mechanical coupling force, with the bonding force being achievable by a latching force or a screw locking force of the seat 1 and the hoop 6.

Between the roots of first insertion terminal 41, second insertion terminal 42, third insertion terminal 43 and the first conducting slip ring 21, second conducting slip ring 22, third conducting slip ring 23 of the armature 2, the roots of first insertion terminal 41, second insertion terminal 42 and third insertion terminal 43 are extended with elastic conducting probes 411, 421, 431. The elastic conducting probe 411, 421, 431 is finally in touch with the first conducting slip ring 21, second conducting slip ring 22 and third conducting slip ring 23, and is elastic. In addition to that the elastic conducting probes 411, 421, 431 can be extended to a different position to contact with the slip rings of unequal radii, an elastic force of a body part extended from the elastic conducting probe 411, 421, 431 can help absorbing the mechanical vibration wave, so as to absorb the gap jump which occurs at contact points between the first insertion terminal 41, second insertion terminal 42, third insertion terminal 43 and the first conducting slip ring 21, second conducting slip ring 22 and third conducting slip ring 23 and is produced by the mechanical vibration wave, thereby maintaining the actual contact between the elements to achieve a better path for the electric current. The implementation of elastic energy for the aforementioned conducting probes 411, 421, 431 can be taken at all or a single root of live wire terminal.

The present invention provides a power plug, wherein the insertion terminals can move relatively to the seat 1, allowing the wiring direction of the electricity conducting element 100 associated with the seat to be changeable. The interior of the seat 1 is provided with the elastic arch element 5 to press the armature 2 toward the inner surface of the turntable 3 by the elastic force of the elastic arch element 5, allowing the first insertion terminal 41, second insertion terminal 42 and third insertion terminal 43 assembled with the turntable 3 to acquire the actual mechanical contact force, such that the better flow path for the electric current can be available between the contact elements. In addition, the parts of the roots of insertion terminals toward the conducting slip rings are extended with the conducting probes with the elastic shear to absorb the mechanical vibration wave when the elements are moving relatively, so as to maintain conducting of electric circuits.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A power plug with a freely rotatable delivery point, comprising:

a plug seat, an end surface of which is provided with an indented circular space, with a bottom of the space being provided with a center axis and the end surface being an open end;

an armature which displaces forward and backward along an axial direction and a working plane of which is distributed with plural concentric conducting slip rings of unequal radii, with the armature being coaxial with the center axis, being installed in the indented space of the seat and being positioned radially by the seat;

a turntable which is loosely connected at the open end of the seat along the same axis as the armature, the turntable being engaged with a tail end of the center axis;

a set of insertion terminals, with an insertion end being vertically distributed on an outward radial surface of the turntable and a root part being extended with a plate-shaped elastic conducting probe which is extended respectively into and is in contact with the conducting slip ring of the armature;

an electricity conducting element, an end of which is linked with and conducts the armature through the seat, and the other end is a delivery point; and an elastic arch element which operates indirectly between an interior of the seat and a longitudinal distance of the armature.

2. The power plug with a freely rotatable delivery point, according to claim 1, wherein the turntable is further limited by a hoop which is assembled with the seat.

3. The power plug with a freely rotatable delivery point, according to claim 1, wherein the elastic arch element is a wave-shaped metallic ring.

4. The power plug with a freely rotatable delivery point, according to claim 1, wherein the elastic arch element is a wave-shaped ring made by rubber.

5. The power plug with a freely rotatable delivery point, according to claim 1, wherein the elastic arch element is an elastic rubber ring.

6. The power plug with a freely rotatable delivery point, according to claim 1, wherein a side at which the seat is assembled with the hoop is provided respectively with a bonding slot.

7. The power plug with a freely rotatable delivery point, according to claim 1, wherein the conducting probe at the root of the terminal stores elastic energy and is implemented as a single live wire terminal.

* * * * *